United States Patent [19]

Prindle

[11] Patent Number: 4,672,385

[45] Date of Patent: Jun. 9, 1987

[54] SATELLITE TRACKING SYSTEM

[75] Inventor: Duane L. Prindle, Hazleton, Iowa

[73] Assignee: Mel-Du Inc., Hazleton, Iowa

[21] Appl. No.: 567,884

[22] Filed: Jan. 3, 1984

[51] Int. Cl.[4] ..... H01Q 3/08

[52] U.S. Cl. ..... 343/766; 343/765; 343/882

[58] Field of Search ..... 343/757, 765, 766, 840, 343/880, 882, 760

[56] References Cited

U.S. PATENT DOCUMENTS

| | | | |
|---|---|---|---|
| 2,651,721 | 9/1953 | Bergey et al. | 343/765 |
| 2,777,122 | 1/1957 | Hedeman et al. | 343/765 |
| 3,707,721 | 12/1972 | McCartney | 343/766 |
| 3,714,660 | 1/1973 | Scrafford et al. | 343/757 |
| 3,999,184 | 12/1976 | Fuss | 343/765 |
| 4,126,865 | 11/1978 | Longhurst et al. | 343/766 |
| 4,454,515 | 6/1984 | Major et al. | 343/882 |

FOREIGN PATENT DOCUMENTS

| | | | |
|---|---|---|---|
| 244423 | 5/1969 | U.S.S.R. | 343/765 |

OTHER PUBLICATIONS

Gabriel Antenna Engineering Notes, Data Sheet No. 5506-1, Mar. 22, 1956.

*Primary Examiner*—Eli Lieberman
*Assistant Examiner*—Michael C. Wimer
*Attorney, Agent, or Firm*—Hugh D. Jaeger

[57] ABSTRACT

Satellite tracking system for use between a ground mount and a satellite dish antenna and including the main components of a gear drive, a worm gear driven by a gear motor, and a coupling shaft connected between the gear and brackets supporting the antenna. The worm gear drive includes a potentiometer connected thereto providing a controller signal input. Limit switches can be provided for limiting the rotation of the antenna between prescribed limits. The worm gear drive provides direct shaft drive for accurate rotation through wide angles.

6 Claims, 4 Drawing Figures

SATELLITE TRACKING SYSTEM

BACKGROUND OF THE INVENTION

1. Field of the Invention

The present invention pertains to a satellite tracking system, and more particularly pertains to an earth station satellite tracking system for support and direct drive of a satellite dish antenna by a direct drive worm gear assembly.

2. Description of the Prior Art

The prior art satellite tracking systems have been less than accurate. The usual prior art systems included essentially motorized trailer jacks which included a considerable amount of gear slop. The movement of the jacks was limited, the jack points were predetermined, as well as the points of attachment, and there was considerable mechanical play. This was less than desirable in providing for accurate rotation of the antenna to predetermined points and also providing for limited movement.

The prior art tracking systems also did not provide for rotation through wide angles, and did not readily situate to the two degree satellite spacing.

Finally, the prior art systems were less than desirable in inclement weather environments such as the snow or cold due to ice freezing, or general other weather-related complications, thereby not providing a reliable system for rotation of the antennas.

The present invention overcomes the disadvantages of the prior art by providing a satellite tracking system for worm gear driven direct shaft drive of a satellite dish antenna attached thereto for rotation through angles to accurate predetermined points.

SUMMARY OF THE INVENTION

The general purpose of the present invention is to provide a satellite tracking system for driving a satellite dish antenna between predetermined points. The system is adaptable to polar mounts and provides a worm gear drive powered by a gear motor for direct shaft drive of the antenna, utilizing the design of a worm gear drive for a positive brake and providing for accurate wide angle rotation. By monitoring the gear drive, it is possible to determine the exact rotation of the dish antenna, also referred to as the satellite antenna and provide for rotation back to predetermined points. This is particularly beneficial for the two degree satellite spacing.

According to one embodiment of the present invention, there is provided a satellite tracking system for rotation of a satellite dish antenna, (e.g., a three meter dish), the dish antenna supported on a four point mounting system, a drive shaft connected to the four point mounting system and coupled to a bull gear, the bull gear driven by a worm gear coupled to a gear motor, the gear assembly of the gear housing supporting the bull gear and worm gear and gear motor supported by a ground support, and a potentiometer coupled to the worm gear for accurately determining the rotation and position of the shaft of the worm gear, which corresponds to the rotation of the shaft of the dish antenna thereby providing an indication of dish antenna rotation about the support. The antenna is capable of being supported through a wide angle of rotation for receiving the two degree satellite spacing.

One significant aspect and feature of the present invention is that the satellite tracking system of the present invention is adaptable to polar mounts.

Another significant aspect and feature of the present invention is that the satellite tracking system for dish antennas for receiving satellite signals is accurate and does not have the free play which previous prior art systems have exhibited.

A further significant aspect and feature of the present invention is a satellite tracking system which rotates the dish antenna through a wide angle very accurately for receiving the two degree satellite spacing of satellites. Also, the system is accurate due to the combination of the bull gear-worm gear drive and the potentiometer coupled to the worm gear, wherein the antenna can always be rotated to a precise predetermined position.

Having best described one embodiment of the present invention, it is the principal object hereof to provide a satellite tracking system for rotating dish antennas about mounts such as polar mounts and other mounts of the art.

One object of the present invention is to provide a satellite tracking system for dish antennas which accurately rotates a dish antenna through a wide angle and senses the position of rotation accurately through a potentiometer coupled to a worm gear in a gear drive assembly.

BRIEF DESCRIPTION OF THE DRAWINGS

Wherein.

DESCRIPTION OF THE PREFERRED EMBODIMENTS

Figure 1:
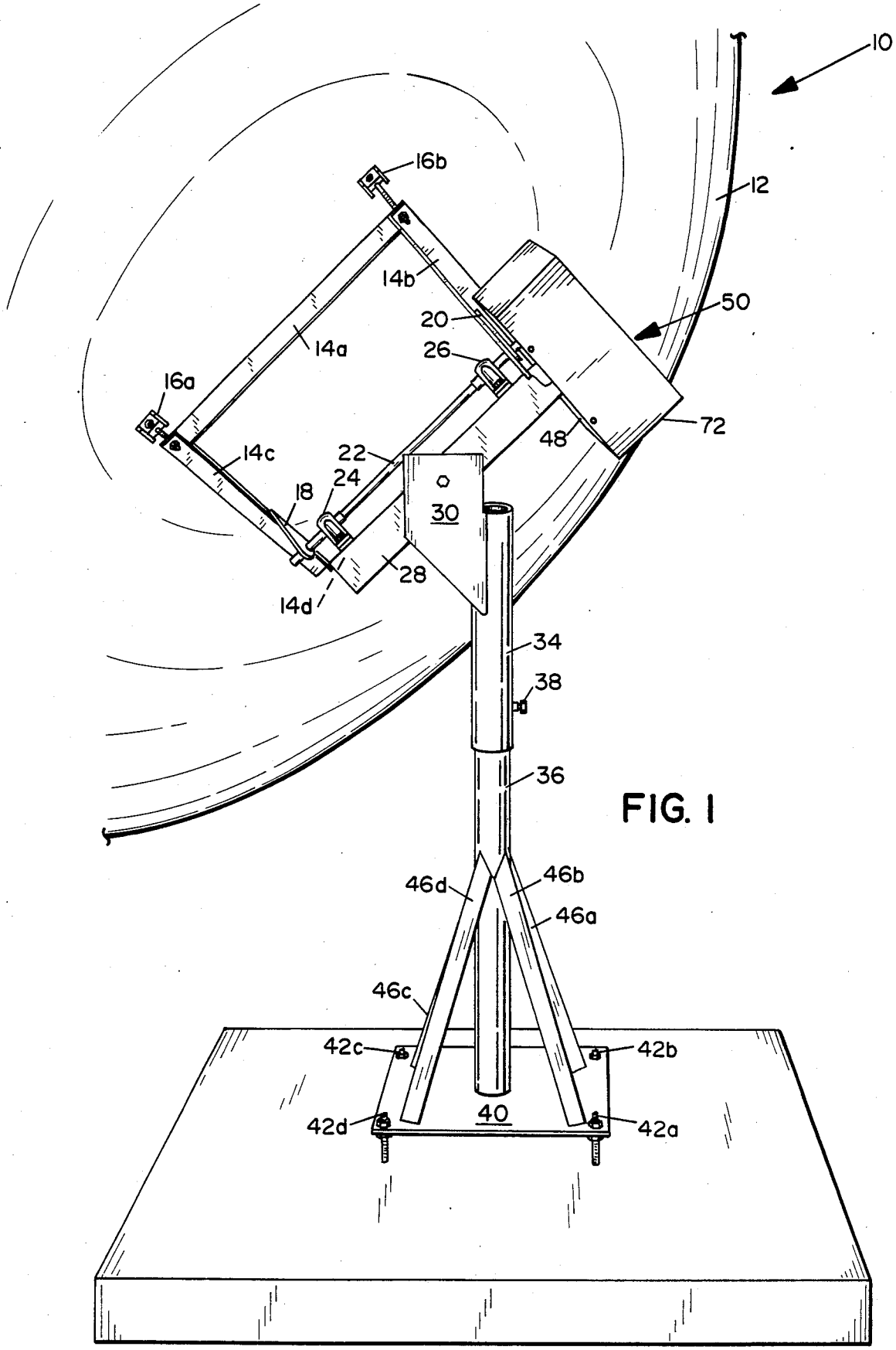
FIG. 1 illustrates a plan view of a satellite tracking system, the present invention.
Figure 2:
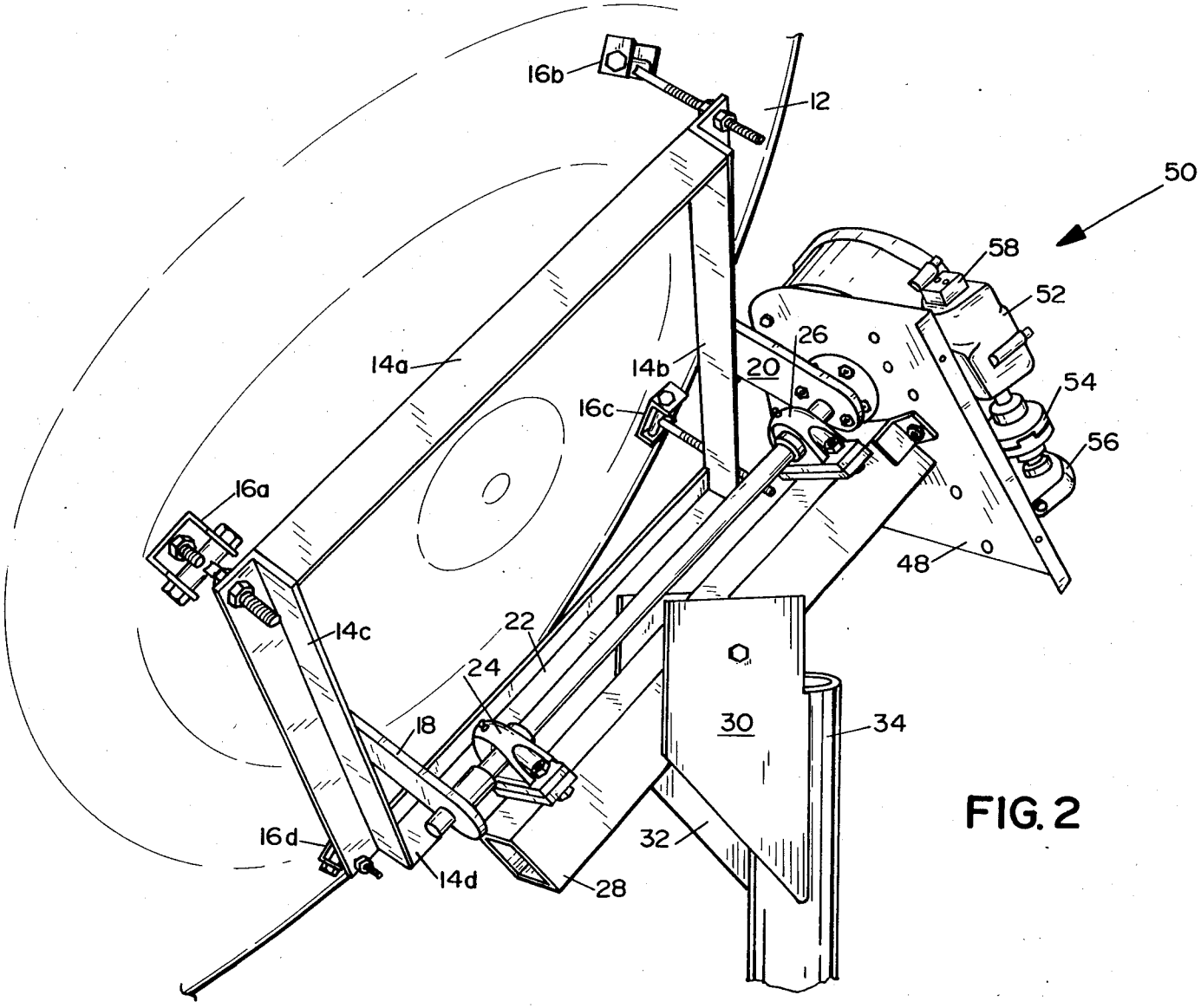
FIG. 2 illustrates a enlarged view of the rotation assembly.

FIG. 1 illustrates a plan view of a satellite tracking system 10, the present invention. System 10 includes a satellite dish antenna 12, a four bar rectangular mounting bracket **14*a*–14*d*, mechanical anchoring system 16*a*–16*d* as also illustrated in FIG. 2 supporting and anchoring the four bar rectangular mounting bracket to the dish antenna 12. Opposing drive bars 18 and 20 connect to the brackets 14*b* and 14*c* and drive shaft 22. Opposing bushings 24 and 26 support the dish antenna assembly including elements 12–20 for subsequent rotation about the bushings 24 and 26. A rectangular support 28 as also illustrated in FIG. 2 supports the bushings. Vertical supports 30 and 32 of FIG. 2 secure between the longitudinal rectangular tube 28 and mounting post 34. The mounting post 34 telescopes over a second mounting post 36 and is secured thereto by adjustment screw 38. The mounting post 36 secures to a base plate 40 which is anchored with anchoring bolts 42*a*–42*d* to a concrete base 44 or the like. A four point quad prod 46*a*–46*d* supports the assembly of elements 34–38. A base 48 secures to the rectangular tube 28 and supports the gear drive assembly 50 as now described and as illustrated in FIG. 2**.

FIG. 2 illustrates an enlarged view of the gear assembly 50 including a gear box 52, a flexible coupling 54, and a gear motor 56. A potentiometer 58 connects to the gear box and acts as a controller-signal input for indicating the position of the satellite antenna as later described in detail.

Figure 3:
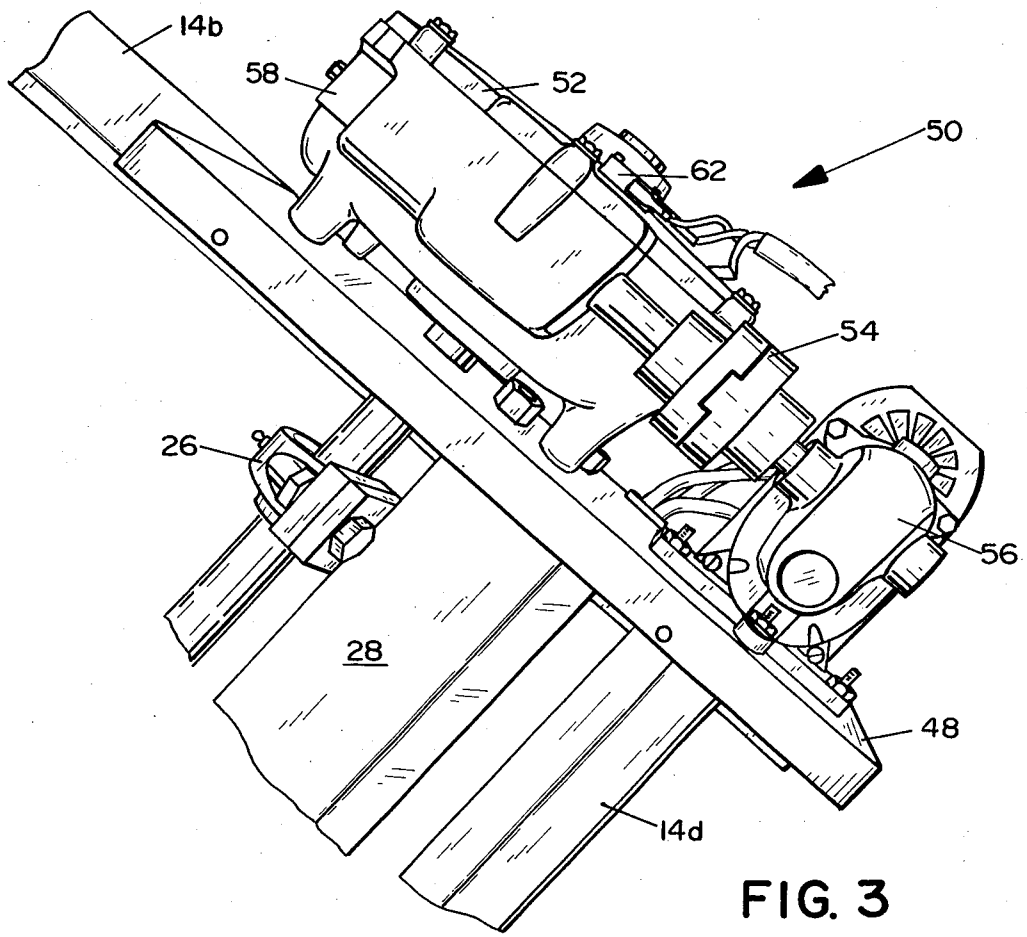
FIG. 3 illustrates an end view of the gear box and gear motor of the rotation assembly.

FIG. 3 illustrates a side view of the gear assembly 50 where all numerals correspond to those elements previously described. The gear motor can have, by way of example and for purposes of illustration only, a 1787:1 ratio with a 9 to 2.8 rpm at 450 inch/lbs tourque. The flexible coupling 54 can be 1.1 horse power per 100 rpm.

Figure 4:
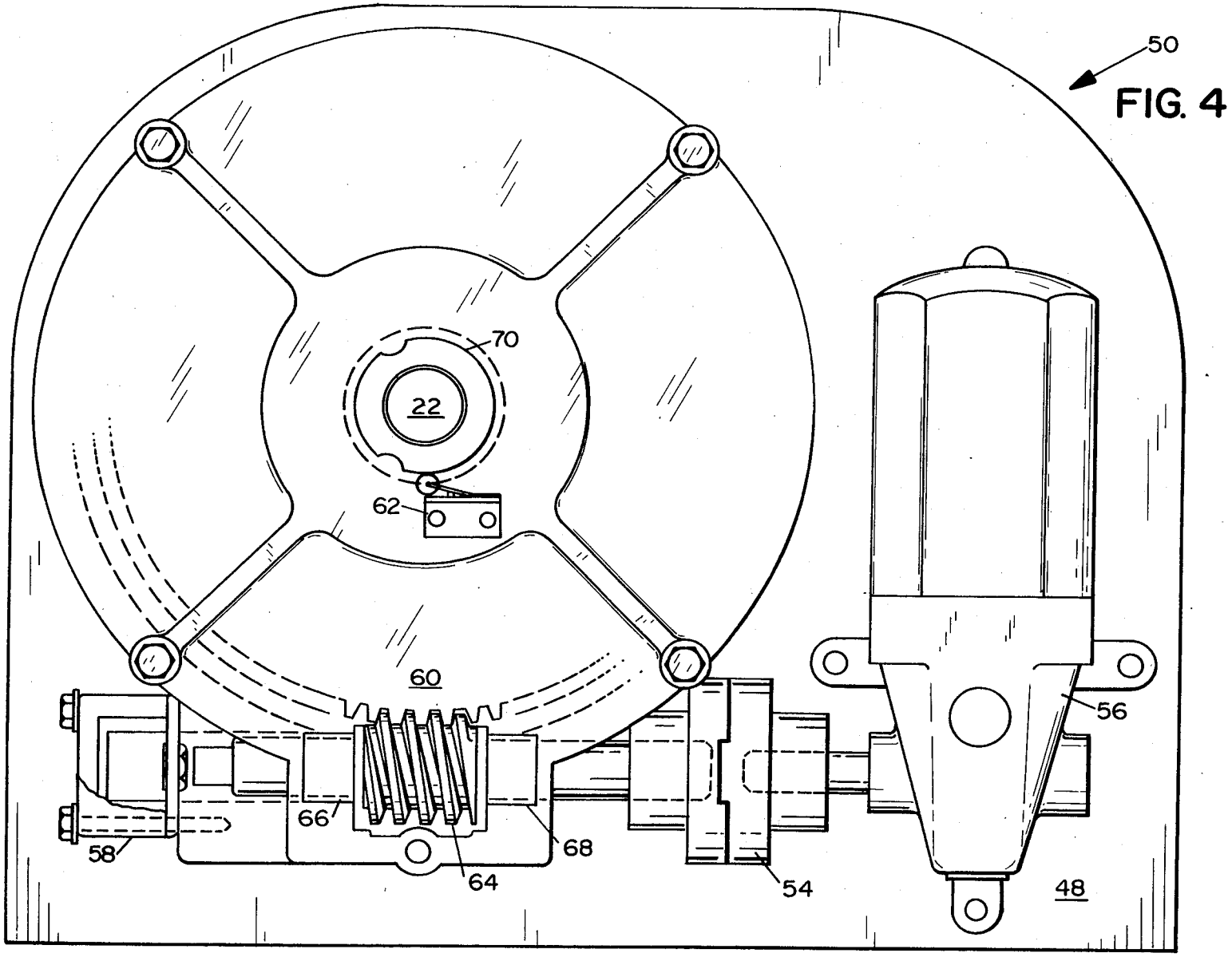
FIG. 4 illustrates a top view of the gear box and gear motor where the gear motor is partially exposed.

FIG. 4 illustrates a top view of the gear assembly 50 where all numerals correspond to those elements previously described. Particularly illustrated the bull gear 60 which can be 10 pitch, cast iron, 8.000 pitch diameter with a 40:1 ratio at 80 teeth. A micro switch 62 is provided as a limit switch. The hardened worm gear 64 is a $1\frac{1}{4}$ pitch diameter, a 0.6283 lead at 9 degrees 5 minutes thread angle. An oil bronzed bushing 66 and 68 are provided for rotation bushings for the worm gear. The potentiometer 58 provides the controller input signal. A limit cam 70 acts in conjunction with the limit switch 62 for limiting the movement over the predetermined angle of rotation. The gear housing can be cast aluminum cover and a cast aluminum gear box. The whole assembly is supported on the base plate 48 and covered with a physically rectangular cover 72 as illustrated in FIG. 1. The shaft 22 mechanically secures to the bull gear 60.

MODE OF OPERATION

The gear motor 56 is driven by a standard power supply such as that providing current to the field and armateur windings of the motor where the field winding is reversed through a double pole double throw switch. The interaction of the worm gear to the bull gear provides for precise mechanical control to the shaft 22 with no free play in between the gear movement. The gear motor imparts the mechanical drive through the coupling to the worm gear. The potentiometer, which can be any number of turns, provides for remote controller input signal to a display such as a digital display or a meter indicating the particular position of the satellite dish antenna with respect to the mounting structure.

The mechanical movement of the dish antenna 12 is best described that the shaft 22 is moved by the worm gear 64 which rotates within the bushings 24 and 26. Subsequently, the elements 14–20 are carried by the drive shaft 22.

I claim:

1. In combination, satellite dish antenna and rotation system comprising:

a. satellite dish antenna including a dish antenna, a four bar rectangular support secured with securing means to an underside of said antenna, two opposing shaft supports extending outwardly from said four bar support, and a shaft secured to said shaft supports, opposing bushings spaced along said shaft, a rectangular tube supporting said bushings, a linearly extensible post secured at one end into a base and at another end to said rectangular tube; and, b. gearing system means including a plate secured to one end of said rectangular tube, a gear box supported on said plate, said shaft extending through said plate and into said gear box, said gear box including a bull gear secured to said shaft and a worm gear, a gear motor connected through a flexible coupling to said worm gear, said worm gear supported in said gear box by oil bronze bushings, and a ten turn potentiometer connected to said worm gear for providing a controller input signal whereby said gear motor rotates said worm gear through said flexible coupling for subsequent rotation of said bull gear connected to said shaft causing said antenna to move in a predetermined rotation.

2. Combination of claim 1 wherein said bull gear is 10 pitch with an 8 pitch diameter, a 40:1 ratio with 80 teeth.

3. Combination of claim 1 wherein said worm gear is a $1\frac{1}{4}$ pitch diameter, 0.6283 lead with 9 degree 5 minute thread angle.

4. Combination of claim 1 wherein said gear motor is 1787:1 ratio at 9 to 2.8 rpm with 450 inch/lbs torque.

5. Combination of claim 1 wherein said flexible coupling comprises a 1.1 horse power per 100 rpm.

6. Combination of claim 1 wherein said combination is for rotating a 3 meter dish.

* * * * *